US006289664B1

(12) United States Patent
Bourquin et al.

(10) Patent No.: US 6,289,664 B1
(45) Date of Patent: Sep. 18, 2001

(54) BRACELET FORMED BY A FLEXIBLE STRUCTURE AND A PLURALITY OF HARD ELEMENTS AND A METHOD OF ASSEMBLING SUCH A BRACELET

(75) Inventors: Aurèle Bourquin, Les Genevez; Jean-Claude Probst, Saignelegier, both of (CH)

(73) Assignee: Protaurec Sarl, Les Genevez (CH)

( * ) Notice: Subject to any disclaimer, the term of this patent is extended or adjusted under 35 U.S.C. 154(b) by 0 days.

(21) Appl. No.: 09/340,383

(22) Filed: Jun. 28, 1999

(30) Foreign Application Priority Data

Jul. 3, 1998 (EP) ..... 98112334

(51) Int. Cl.[7] ..... A44C 5/02; F16G 13/18; B21L 17/00

(52) U.S. Cl. ..... 59/80; 59/93; 63/4

(58) Field of Search ..... 59/78, 88, 93; 63/4

(56) References Cited

U.S. PATENT DOCUMENTS 1,820,576 * 8/1931 Mealy ..... 59/80
2,165,115 7/1939 Schultheiss .
3,682,603 8/1972 Pompeo ..... 29/160.6

FOREIGN PATENT DOCUMENTS 0 557 578 A1 9/1993 (EP) .

* cited by examiner

*Primary Examiner*—David Jones
(74) *Attorney, Agent, or Firm*—Griffin & Szipl, P.C.

(57) ABSTRACT

A bracelet (2) formed by a flexible structure (4) and a plurality of hard elements (6) defining a hard structure, especially a metal structure, arranged in the median region (8) of the bracelet. The hard elements and the flexible structure comprise complementary fixing means defined by respective parts (20, 22) which form mutual abutments in a direction perpendicular (24) to the general surface (26) defined by the flexible structure. This flexible structure comprises elastically deformable parts which are stressed for assembly of the hard elements therewith. The features of the bracelet allow easy assembly without damage. Moreover replacement of the flexible part can be effected without damaging the hard elements, especially elements of gold.

18 Claims, 8 Drawing Sheets

BRACELET FORMED BY A FLEXIBLE STRUCTURE AND A PLURALITY OF HARD ELEMENTS AND A METHOD OF ASSEMBLING SUCH A BRACELET

FIELD OF THE INVENTION

The present invention relates to a bracelet formed by a flexible structure and a plurality of hard elements, especially metal elements. Some manufacturers of bracelets have already proposed bracelets which associated hard elements, especially metal elements, with flexible structures, especially of leather or fabric, in such a manner as to provide bracelets having an original aesthetic appearance.

BACKGROUND OF THE INVENTION

The design, construction and assembly of such a bracelet is not at all clear to a man skilled in the art. Moreover, especially when the hard elements are made from a noble metal and the flexible structure suffers relatively major ageing from the wearer, it is necessary to be able to separate the hard elements from the flexible structure without damaging them. It is then desirable to be able to replace the flexible structure to renew a bracelet according to the invention, by assembling the hard elements with the new flexible structure. To this end it is desirable that the method of assembly will be efficient and relatively simple, to allow a user or a retailer to effect the replacement of the flexible structure himself and thus effect the assembly of the new flexible structure with the hard elements.

SUMMARY OF THE INVENTION

The present invention seeks to provide a composite bracelet having, along a longitudinal direction of the bracelet, a median region in which the hard elements are located and two lateral regions located on one side and the other respectively of the median region, these lateral regions being formed by a flexible structure, in particular by a structure whose upper part is of leather or fabric. It is preferably provided that the hard elements associated with the same length of the bracelet are directly connected to one another in an articulated manner, thus themselves forming in themselves a metal bracelet which is assembled with a flexible structure comprising in one preferred embodiment a lower layer covering the said hard elements forming the central part of the visible face of the bracelet.

In one embodiment, an expansion of the flexible structure is provided, in the general surface defined by the bracelet, during the assembly of this structure with the hard elements in the median part of the bracelet.

In another embodiment of the invention an elastic deformation of the flexible structure is provided in a direction substantially perpendicular to the general surface of the bracelet during assembly of the flexible structure with the hard elements. This deformation takes place essentially in the vicinity of wings provided along the internal edges of the two longitudinal parts of the flexible structure located in the two lateral parts respectively of the bracelet.

Other features of the invention, in particular those set forth in the claims, and advantages of the invention will be seen clearly from the following detailed description, given with the aid of the accompanying drawings, and by way of non-limiting example.

DESCRIPTION OF PREFERRED EMBODIMENTS

Figure 1:
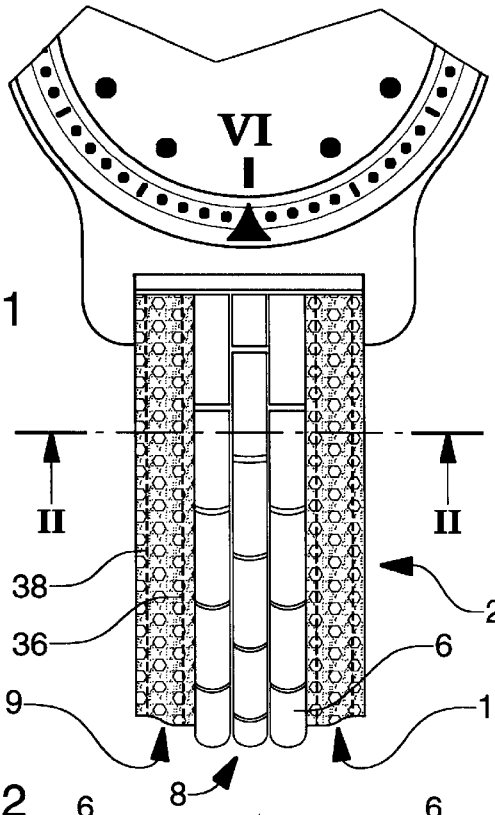
FIG. 1 is partial view from above of a watch provided with a bracelet according to a first embodiment of the invention.
Figure 2:
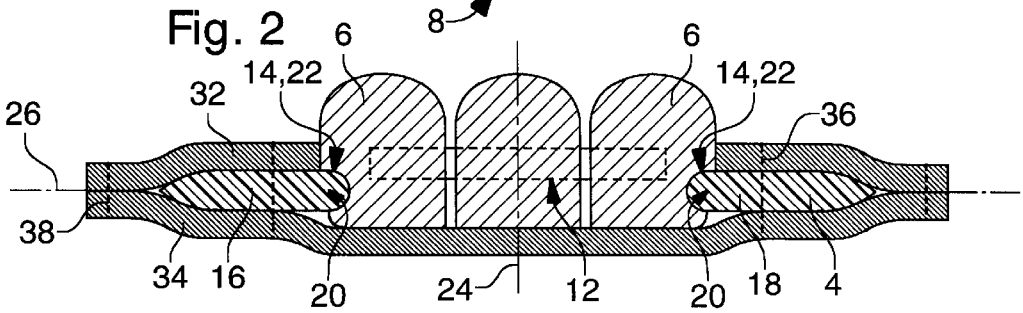
FIG. 2 is view in section along the line II—II of FIG. 1.

A watch-bracelet is shown in FIGS. 1 and 2, of which the bracelet 2 is formed by a flexible structure 4 and a plurality of hard elements 6. The flexible structure 4 defines a median region 8 along a longitudinal direction of the bracelet which is perpendicular to the section line II—II of FIG. 1, and two lateral regions 9 and 10 located on one side and the other of this median region. The hard elements 6, formed of metal or ceramic for example, are arranged in the median region 8. The hard elements of the same length of the bracelet 2 are connected directly to one another in an articulated manner, represented schematically by a pin 12. Thus the hard elements form the links of a median structure of the bracelet 2, these links being assembled in the manner of a metal bracelet known to the man skilled in the art. However, in another embodiment, the hard elements may not be connected directly to one another in an articulated manner, but be assembled individually or by group with the flexible structure 4 of the bracelet 2.

The elements 6 are assembled with the structure 4 by means of complementary fixing defined for the one part by lateral surfaces 14 provided on the outer sides of the elements 6 adjacent the two longitudinal parts 16 and 18 forming the structure 4 and for the other part by parts 20 of this structure 4 engaged in lateral grooves 22 defining the lateral surfaces 14. The parts of the chains 5 where the lateral grooves 22 are provided define abutments for the parts 40 of the structure 4 in the direction 24 perpendicular to the general surface 26 defined by the structure 4. Likewise the parts 20 form abutments in the direction 24 for the links 6 adjacent to the longitudinal parts 16 and 18. In consequence, the hard elements 6 defining the links of a hard structure, in particular metallic, are fixedly assembled with the flexible structure 4.

In order to assemble the flexible structure 4 with the hard structure formed by the links 6, it is provided in accordance with the invention that the structure 4 has elastically deformable parts which are stressed for this assembly, in particular to allow the two longitudinal parts 16 and 18 to be spread apart in the case of the present embodiment during the introduction of the links 6 to form the bracelet 2. Moreover these elastically deformable parts ensure that the parts 20 of the structure 4 are held within the lateral grooves 22.

Within the framework of this first embodiment, it is possible to introduce the elements 6 by force/pressing into the flexible structure 4. To this end, the elements 6 adjacent to the longitudinal parts 16 and 18 and these parts 16 and 18 have complementary profiles allowing such assembly by force/pressing the median hard structure into the flexible structure 4.

Figure 3:
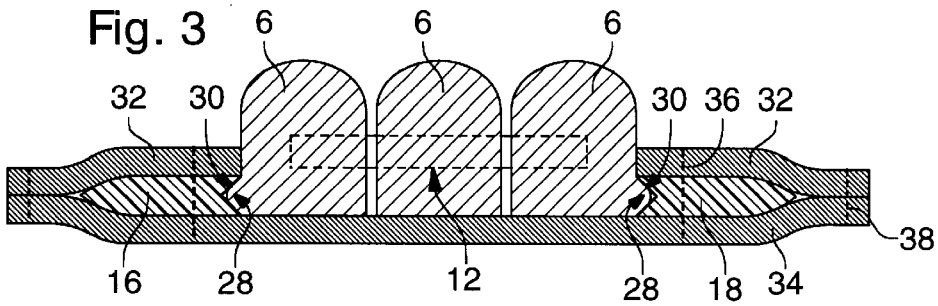
FIG. 3 shows a variant of the first embodiment.

In FIG. 3 is shown a variant of the first embodiment which differs from this in that the complementary fixing means are formed for the one part by lateral projections 28 provided on the hard elements 6 adjacent the longitudinal parts 16 and 18 and for the other part by complementary grooves 30 provided in these parts 16 and 18 and in which the projections 28 are engaged.

Finally, it is noted in this first embodiment that the flexible structure 4 is covered by an upper layer 32 and a lower layer 34. The upper layer 32 has at least one opening for the passage of the elements 6 which emerge through this opening. On the contrary, the lower layer 34 covers the bottoms of the elements 6 in such a manner that this layer 34 is in contact with the arm of the wearer of the watch shown in FIG. 1. This ensures good comfort for the wearer of the bracelet 2, the problems associated with a metal bracelet, especially those involving pinching of the skin or hairs, being non-existent. Moreover, the cold feeling which can result from wearing a metal bracelet is equally overcome by the lower layer 34.

The bracelet 2 thus has a hard structure, especially metallic, in its median region with an appearance identical to that of a bracelet of metal links, without however suffering the problems. Moreover the arrangement of the two lateral regions 9 and 10 in which extends essentially the structure 4 makes it possible to achieve an outstanding aesthetic effect. Thus, the upper layer 32 can be made from various materials, especially from leather or a fabric whose marriage with the hard elements 6 gives a particularly impressive aesthetic effect. The layers 32 and 34 are assembled with the flexible structure 4 by means of stitching 36, the external stitching 38 also provided finishing touches to the bracelet 2.

A second embodiment will be described below with the aid of FIGS. 4 to 7. The elements similar to those of the first embodiment and carrying the identical reference numbers will not be described again here. The elements 6A are similar to the elements 6 shown in FIG. 3, with the exception of the parts of the elements 6A defining the complementary fixing means of the hard structure with the flexible structure. The parts 40 of the links 6A adjacent to the longitudinal parts 16A and 18A of the flexible structure 4A each have a face substantially parallel to the general surface 26 of the flexible structure 4A, these top faces forming abutments for the parts 42 of the structure 4A. The faces of the parts 42 in abutment with the abovementioned faces of the lower peripheral projections 40 are likewise parallel to the general surface 26. The parts 40 and 42 mutually define abutments in the direction 24 perpendicular to the general surface 26. In this second embodiment, the structure 4A has parts 42 forming abutments in only one sense, i.e. they only prevent the hard elements 6A from coming out through the opening provided in the upper layer 32. The assembly of the hard elements 6A with the flexible part of the bracelet is also ensured by the lower layer 34, which retains the elements 6A. In this way, once they are assembled, the elements 6A are fixed in the flexible part of the bracelet according to the invention.

According to a particularly advantageous improvement of the present invention, the longitudinal parts 16A and 18A of the flexible structure 4A are connected transversely by transverse parts 46. These transverse parts are preferably elastically deformable. This property is made use of during the assembly of the hard elements 6A with the flexible part of the bracelet comprising the structure 4A.

The transverse parts 46 are more or less entirely covered by the hard elements 6A. To this end the elements 6A have transverse recesses 48 or transverse grooves 50 for the passage of these parts.

The elements 6A have either a transverse recess 48 or a lower transverse groove 50, depending on their position relative to the structure 4A. The transverse parts 46 are multi-functional. In the first place they ensure a material connection between the longitudinal parts 16A and 18A, which stiffens the flexible structure 4A and thus allows the openings 52 of the structure 4A and the opening in the upper layer 32 fixed to this layer 4A to be held to given dimensions, so determined that the hard elements 6A forming the hard structure have a transverse dimension fully matched to the transverse dimensions of these openings. Secondly, the abovementioned matching between the transverse dimension of the hard structure and the transverse dimension of the openings 52 of the structure 4AA is maintained because the transverse parts 46 have a slight elastic deformation enabling the longitudinal parts 16A and 18A to exert some lateral gripping force on the hard structure. This makes it possible to avoid the appearance of gaps between the layer 32 and the hard structure. Thirdly, the transverse parts 46 are stretched during the assembly of the hard structure with the flexible part of the bracelet, as is shown in the right part of FIG. 5.

In one method of assembly according to the invention, the following successive steps are provided for assembly of the bracelet according to the second embodiment:

A) Spread the two longitudinal parts 16A and 18A away from one another with the aid of gripping means and spreading apart by elastic elongation of the parts 46;

B) Introduce the plurality of hard elements 6A forming the hard structure into the median region 8 in such a manner that the complementary fixing means 40 and 42 pertaining to the hard elements and the flexible structure respectively are located in respective positions relative to one another in a direction 24 perpendicular to the general surface 26 of the flexible structure 4A, which correspond to the relative positions defined in this perpendicular direction after assembly;

C) Restore the longitudinal parts 16A and 18A to an assembled position in which the transverse parts 46 are either not deformed elastically or are slightly deformed elastically in such a manner that the flexible structure 4A exerts some transverse force on the elements 6A adjacent to these longitudinal parts 16A and 18A; or release the gripping so that these two longitudinal parts come into such an assembled position.

This method of assembly and the reverse procedure for separation have several advantages. Firstly, it allows the flexible part of the bracelet to be exchanged without exerting mechanical constraints on the median structure formed by the hard elements. Thus this hard structure is not damaged either during assembly with the flexible structure nor during separation of the flexible and hard structures. This is particularly important when the hard elements are made of relatively soft metal, such as gold. When the flexible part, particularly the covering layers are of leather or fabric, it is necessary to be able to change this flexible part periodically. Thanks to the method of the invention, a retailer or even the user himself can effect such an exchange, given the necessary gripping and spreading apart means.

It is noted that, in the case in which assembly by force/pressure on the hard elements is provided, the separation of the hard structure from the flexible structure can be effected in a reverse manner to the assembly procedure described above. The invention thus concerns both a method of separating a flexible structure and a median hard structure for bracelets according to the invention described above, in which it is provided to spread apart the longitudinal parts of the bracelet with the aid of gripping and spreading apart means, in such a manner as to disengage the complementary parts of the complementary fixing means serving to assemble the flexible and hard structures. Once this spreading apart has been effected, the hard structure is separated from the flexible structure in a direction perpendicular to the general surface of this flexible structure. In the case of the embodiment of FIGS. 1 and 2, such a method of separating the flexible and hard structures is advantageous. In the variant shown in FIG. 3, it is equally possible to separate these structures by pressing in the median region of the lower layer of the flexible part. Under the action of this pressure, the longitudinal parts of the flexible structure spread apart and the hard structure is separated from the flexible structure. However, it is noted that emphasis is placed in the case of the present invention on a solid and reliable assembly between the flexible part of the bracelet and the median hard structure. Thus in the case in which the hard structure can be separated from the flexible part by pressure, the force necessary to spread apart the longitudinal parts of the flexible structure sufficiently to disengage the hard structure is made relatively large and much greater than the forces exerted on the bracelet in a direction perpendicular to its general surface during wear or during the usual manipulations.

Figure 8:
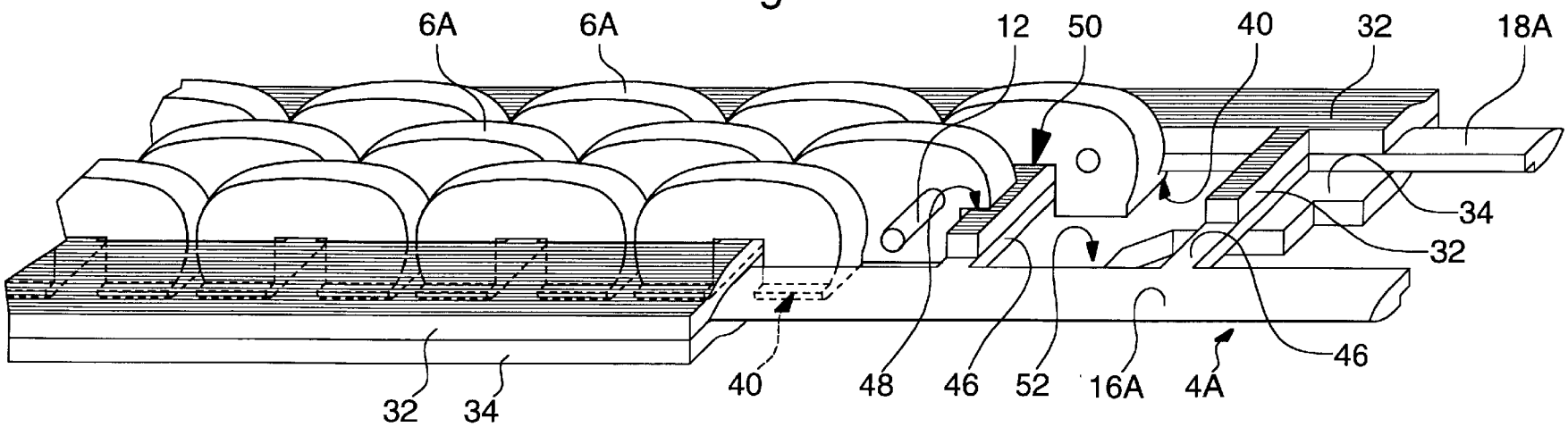
FIG. 8 is a partially broken away view in perspective of a variant of the second embodiment.

A variant of the second embodiment is shown in FIG. 8. This variant is distinguished in that the transverse parts 46 of the structure 4A are covered by the upper cover layer 32. The lower transverse grooves or the transverse recesses provided for the passage of the transverse parts 46 are so dimensioned as to allow passage of the cover layer. Such a variant has the advantage of allowing preliminary assembly of the structure 4A with the cover layer 32 before making the openings 52 in the structures 4A and the corresponding openings in the layer 32. Moreover, this allows the longitudinal parts of the layer 32 to be applied flat against the hard elements or links adjacent to these longitudinal parts.

Figure 9:
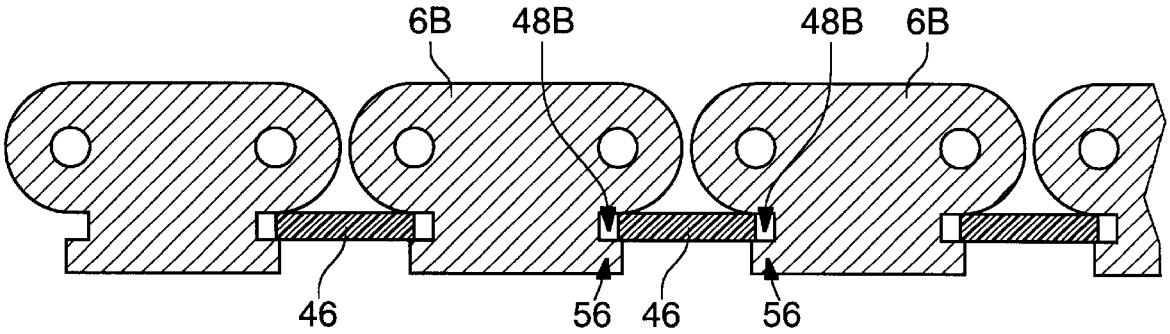
FIG. 9 is a view in section similar to FIG. 7 and showing a variant implementation.

Another variant implementation is shown in FIG. 9, in which the hard elements 6B with a transverse recess 48B for passage of the transverse parts 46 have lower projections 56 defining the recesses 48B in part. These projections 56 are so provided that the introduction of the transverse parts 46 is effected easily when the elements 6B are located substantially in one plane. The depth of the recesses 48B is provided in such a manner that the transverse parts 46 do not impede the bracelet bending round, in particular when it is worn on the wrist. These projections 56 serve to fix the elements 6B to the flexible structure when the bracelet is bent round in the wearing sense.

In order to facilitate the introduction of the transverse parts 46 into the recesses 48B, it is possible to bend the bracelet in the sense contrary to that when worn in such a manner as to space apart the adjacent projections 56.

Figure 4:
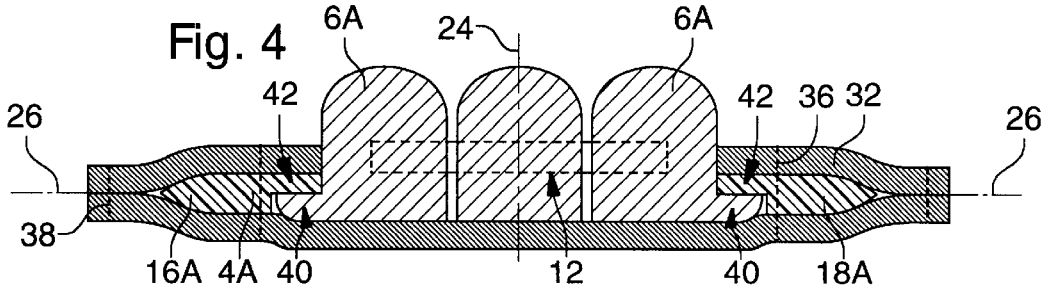
FIGS. 4 and 7 are two views in section of a second embodiment, respectively according to the section line IV—IV of FIG. 6 and the section line VII—VII of FIG. 5, these FIGS. 5 and 6 being partially broken away views in plan and perspective respectively.
Figure 5:
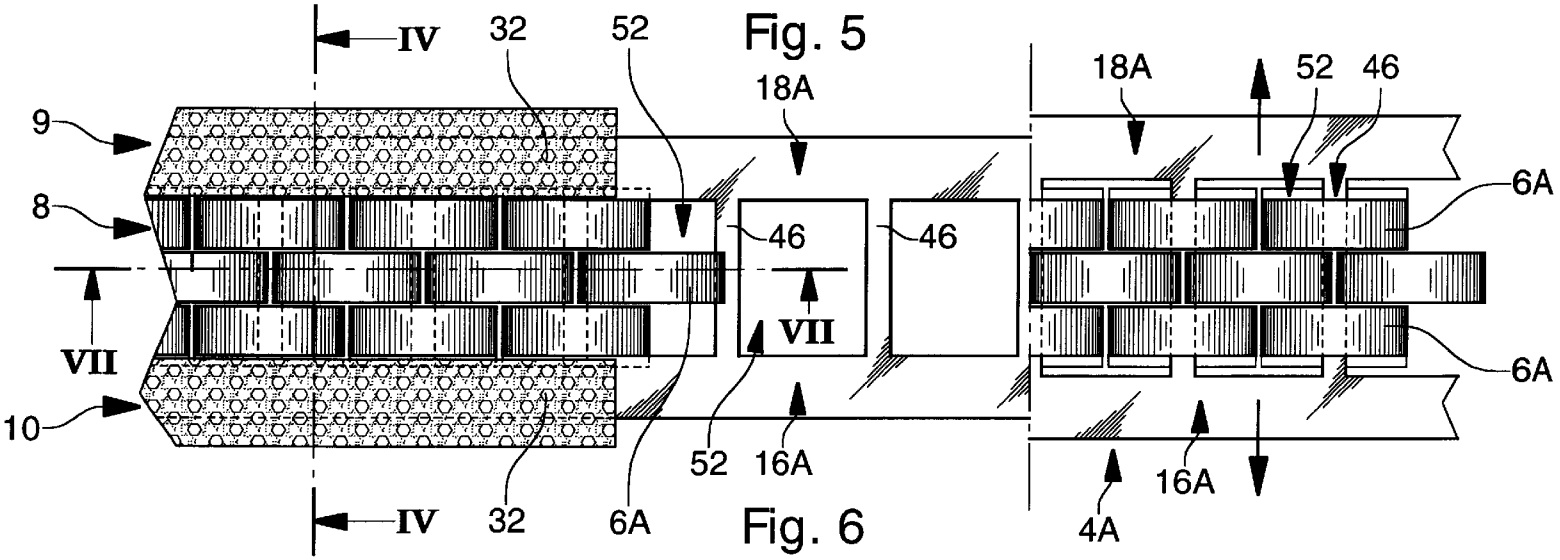
Figure 6:
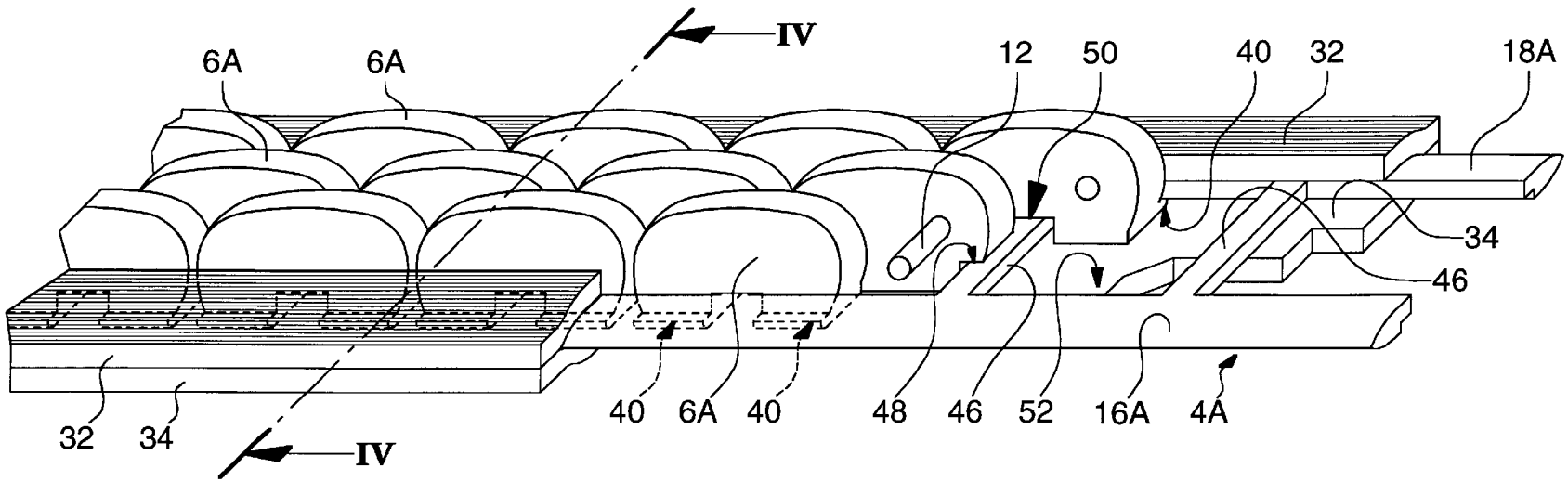
Figure 7:
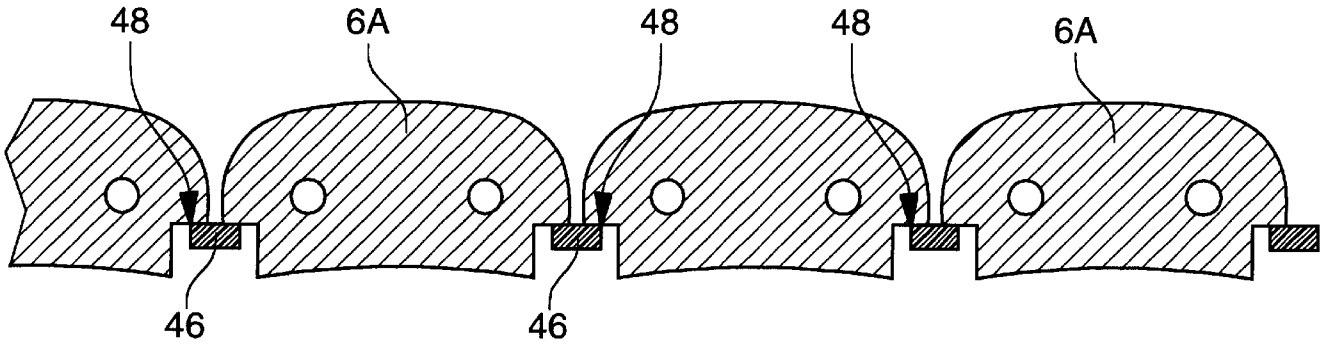
Figure 10:
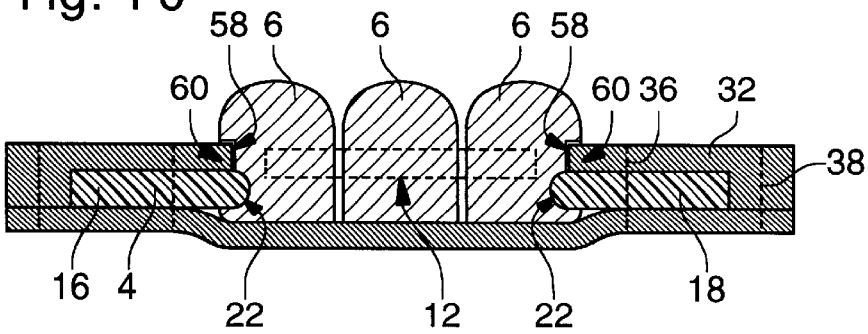
FIGS. 10 and 11 represent two variants in a view in section like FIGS. 2 to 4, of a third embodiment of the invention.
Figure 11:
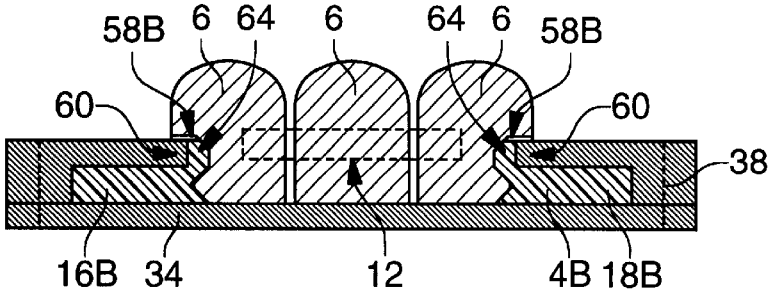

Two variants of a third embodiment are shown in FIGS. 10 and 11, in accordance with sections like those of FIGS. 2 to 4. The embodiment of FIG. 10 is distinguished from that of FIG. 2 in that upper recesses 58 are provided in the links or hard elements adjacent to the longitudinal parts 16 and 18, in which the edges 60 of the upper cover layer 32 are engaged. This is particularly advantageous to maintain these edges flat against the structure 4. Moreover, in a view from above, this particular arrangement eliminates a visible gap between the hard elements 6 and the longitudinal parts of the layer 32. By providing a height of the recesses 58 matched to the height of the edges 60 or slightly less than this, so as to pinch these edges gently, a high quality finishing touch is achieved, avoiding dirt getting between the edges 60 and the recesses 58.

The variant of FIG. 11 is distinguished essentially from FIG. 3 in that the flexible structure 4B has upper protuberances 64 in the region of the internal edges of the two longitudinal parts 16B and 18B, located at the level of the upper layer 32. The protuberances 64 and the internal edges 60 of the layer 32 are located in recesses 58B provided to this end. The protuberances 64 have a particular advantage in the case of introduction of the links 6 by force into the flexible structure 4B. The structure 4B can be made of a material more resistant and less easily damaged than the material forming the layer 32, the protuberances 64 on the one hand allowing damage to the edges 60 during assembly of the bracelet to be avoided and on the other hand increasing the stability of the ensemble by better retention of the elements 6. Finally, it is provided that the layer 32 is bonded to the layer 4B. Because of this, only one external stitching 38 is provided.

Figure 12:
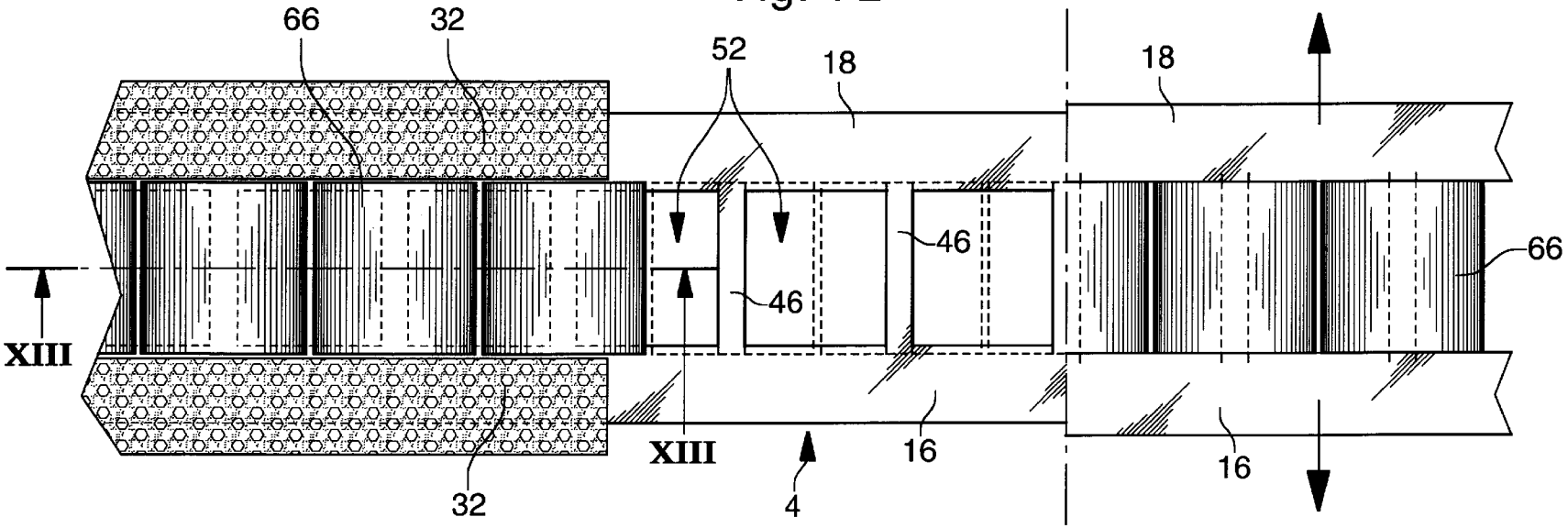
FIGS. 12 and 13 are views in plan and section along the line XII—XII respectively of a fourth embodiment.
Figure 13:
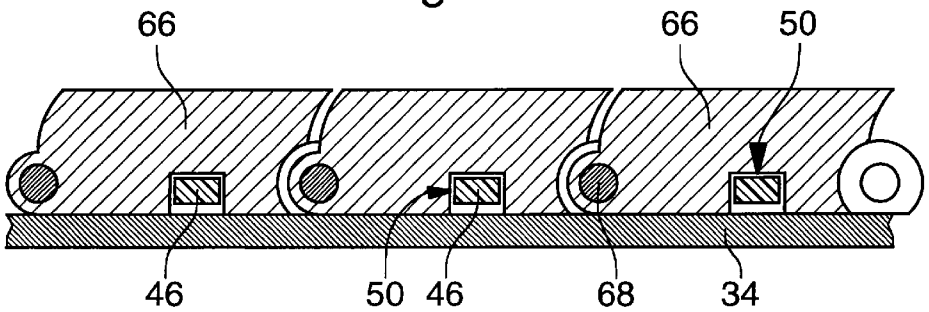

A fourth embodiment is shown in FIGS. 12 and 13, in which the hard elements 66 each occupy the whole width between the two longitudinal parts 16 and 18 of the flexible structure 4. The fixing means provided for assembling the links 66 with the flexible part of the bracelet are equivalent to those shown in FIG. 2. Each link has a lower groove 50 for passage of the transverse parts 46 of the structure 4. The elements 66 are connected directly to one another in articulated manner by means of pins 68.

According to a variant implementation, it is possible to provide for each of the elements 66 to be introduced into an opening 52 in the structure 4, without the elements being directly connected to one another. Each element is thus fixed to the structure 4 by fixing means according to the invention provided at the lateral edges of the elements 66. In this variant, the transverse parts 46 are advantageously covered by the upper layer 32. It is noted however that this variant implementation has a disadvantage because each of the elements 66 has to be mounted separately and, when changing the flexible part, the hard structure formed by these links 66 does not form an integral unit. On the other hand, it is possible to do without direct connecting means between the hard elements 66 and replacement of single damaged link is relatively easy in this case.

As is shown in the right part of FIG. 12, the elements 66 are introduced by force/pressing into the openings 52 of the flexible structure 4. On exerting pressure on the elements 66, the longitudinal parts 16 and 18 spread apart under the action of the resultant forces in the region of the respective profiles of the complementary parts forming the fixing means.

In the four embodiments described above, the flexible structure 4, 4A or 4B is formed in particular either by a plastics material, especially a polyester or polyamide, or by a material based on a natural or synthetic fibre, especially Kevlar® or a similar material, or by natural or synthetic rubber based on Neoprene® or a silicone. These examples are not limitative. It is sufficient if the flexible structure can curve round easily in the longitudinal direction of this structure with some mechanical resistance against deformation in the region of the parts forming the complementary fixing means, so as to ensure firm fixing of the hard structure to the flexible structure.

As to the cover layers for the flexible structure, any material with the requisite flexibility for a bracelet can be envisaged, especially leather, a fabric or rubber.

Figure 14:
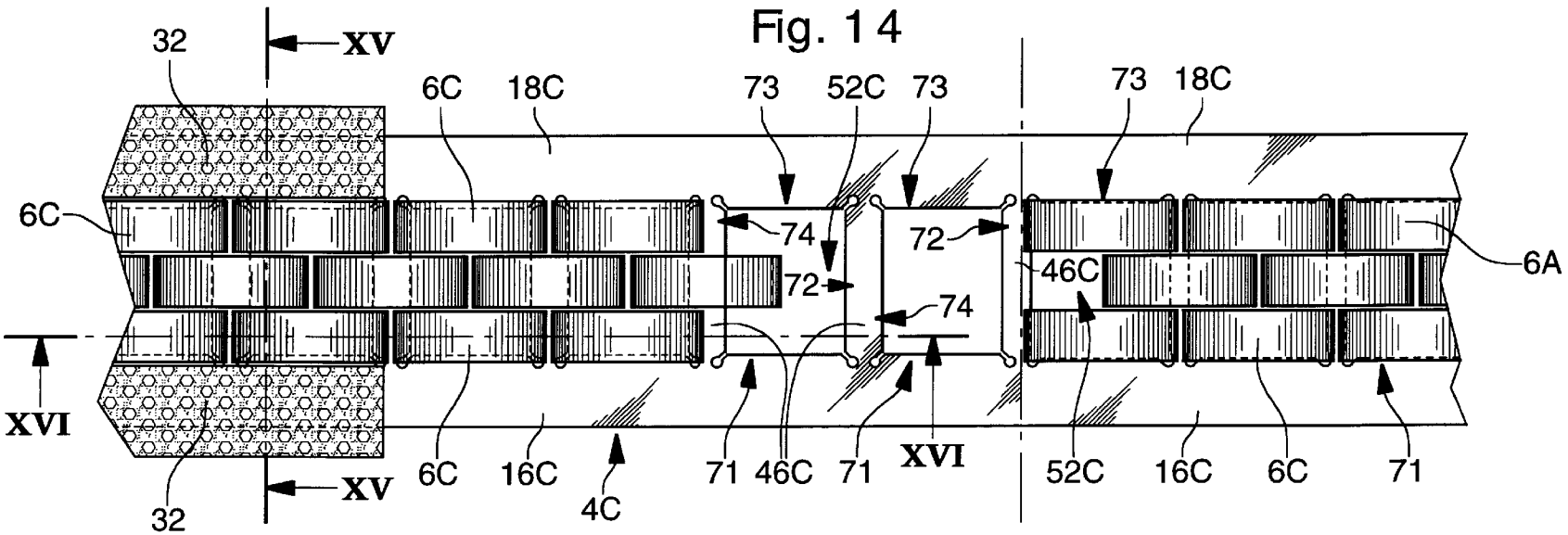
FIG. 14 is view similar to FIG. 5 of fifth embodiment of the invention.
Figure 15:
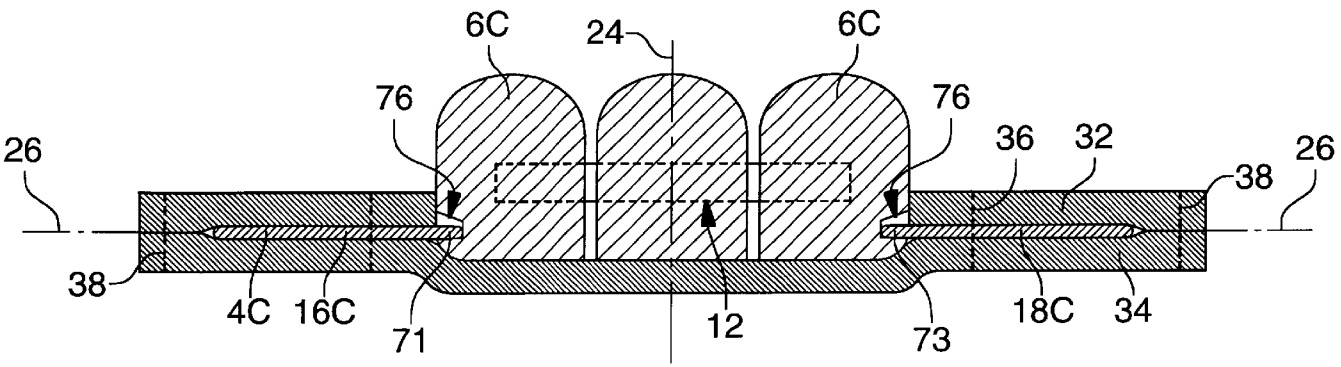
FIGS. 15 and 16 are two views in section along the lines XV—XV and XVI—XVI respectively of FIG. 14.
Figure 16:
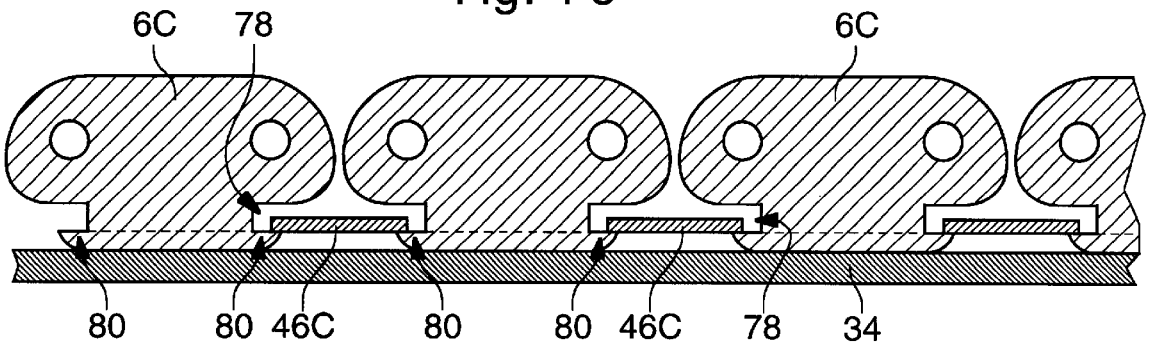

A fifth embodiment of the invention will now be described with reference to FIGS. 14 to 16. This mode of implementation is distinguished from the preceding ones in that the flexible structure 4C is formed by a thin metal lamella. This structure 4C also has two longitudinal parts 16C and 18C connected by transverse parts 46C defining openings 52C.

Each opening 52C has four wings 71, 72, 73 and 74 at its edges. These wings form the elastically deformable parts of the flexible structure 4C and at the same time define the complementary parts forming the fixing means pertaining to this structure. The assembly of the hard structure, formed by the links or elements 6C, with the flexible part of the bracelet is effected by engagement with force/pressure on these elements 6C into the openings 52C. The application of pressure on the elements 6C, placed properly on the structure 4C, causes elastic deformation of the wings 71 to 74 in a direction substantially perpendicular to the general surface of the structure 4C, as is shown in the right part of FIG. 14. The parts of the elements 6C in contact with the wings are profiled in such a manner as to allow with elastic deformation, which increases the dimensions of the openings 52C in the said general surface. Thus the hard elements penetrate the structure and the wings 71 to 74 return substantially to the general surface and engage in the lateral grooves 76 shown in FIG. 15 and in the recesses 78 shown in FIG. 16.

It is noted that, within the scope of the present invention, only the wings 71 and 73 are necessary for fixing the hard structure to the flexible structure. The supplementary fixing provided in the region of the transverse parts 46C provides an advantageous improvement of the invention. Accordingly it is possible to provide a variant of the structure 4C with only two wings 71 and 73 per opening 52C, formed by the internal edges respectively of the two longitudinal parts 16C and 18C.

The recesses 78 are profiled in such a manner as to allow the bracelet to curve round when worn on the wrist. The lower projections 80 serve to ensure supplementary fixing, especially when worn, in that these projections 80 approach one another when the hard structure is curved round in the sense of wearing. It is noted that the profiles of the lateral grooves 76 and the recesses 78 provided in the links or elements 6C shown in FIGS. 15 and 16 are schematic. Other profiles can be envisaged by the man skilled in the art for ensuring effective assembly by pressure and firm fixing of the flexible and hard structures.

In order to separate the hard structure from the flexible structure it is possible to exert a strong pressure on the median part of the lower layer, to allow the links 6C to disengage from the flexible structure. However, when the flexible foil is particularly worn out, the separation is preferably effected with the aid of a suitable cutter or a cutting press, by cutting the flexible part along the sides of the hard structure, which allows the transverse parts 46C to be cut off at their two ends.

Figure 17:
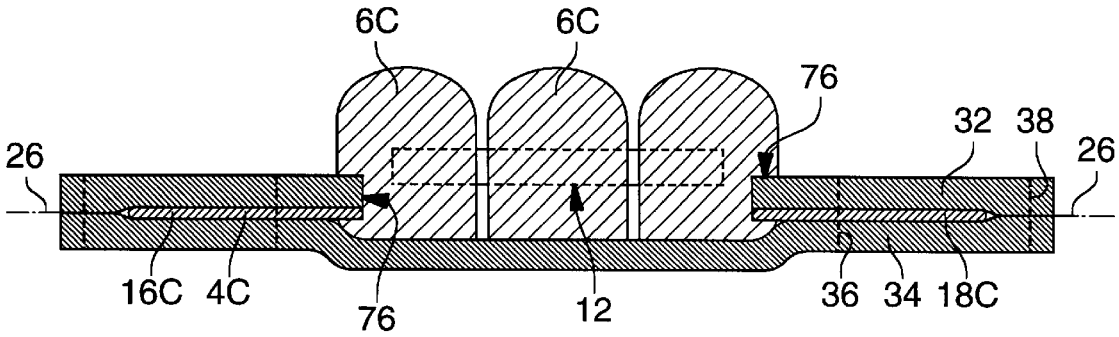
FIGS. 17 and 18 are views in section similar to FIGS. 15 and 16 respectively of a variant of the fifth embodiment.
Figure 18:
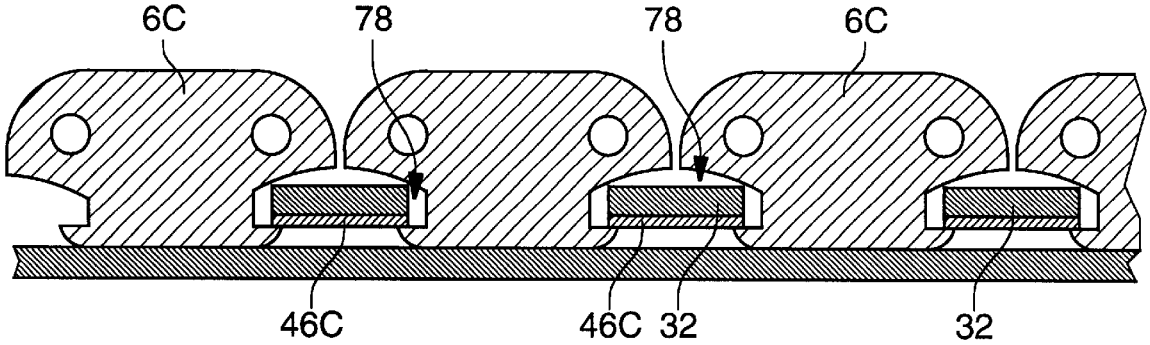

A variant of the third embodiment is shown in FIGS. 17 and 18, which is distinguished in that the thin metal lamella 4C is covered integrally by the cover layer 32. This lamella and this layer can be pre-assembled, especially by bonding, before the openings 52C in the layer 4C and the corresponding openings in the layer 32 are made simultaneously. Moreover, in this variant, the advantages described in relation to the third embodiment are also present.

Figure 19:
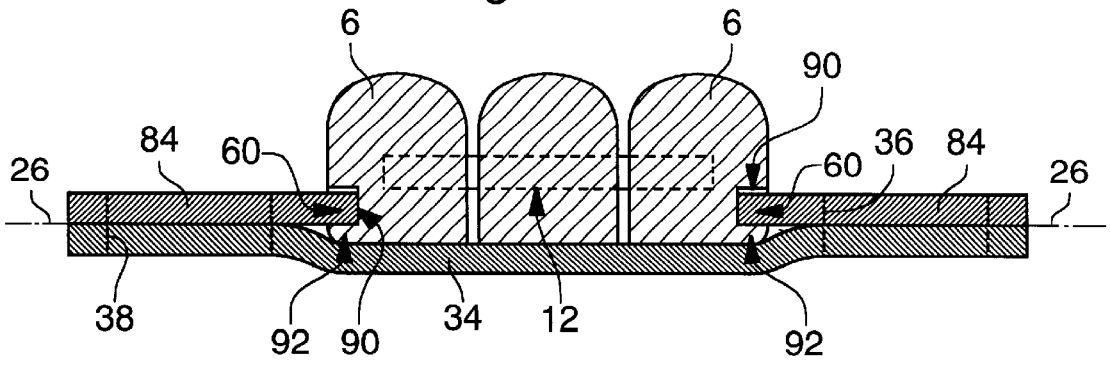
FIGS. 19 to 21 are views in section, similar to FIGS. 2 to 4, representing sixth, seventh and eighth embodiments of the invention respectively.

A sixth embodiment is shown in FIG. 19, in which the flexible structure 84 also forms the upper layer of the bracelet in the two lateral regions thereof. The flexible structure 84 can be formed of a rubber or a leather for example. The internal edges 60 of the two longitudinal parts of the structure 84 can in particular be specially treated in the manner of hardening these edges 60 to ensure adequately firm and reliable fixing of the hard structure formed by the elements 6 to the flexible part of the bracelet formed by the structure 84 and the lower layer 34. In a preferred variant, there is an intermediate layer between the layers 34 and 84 to compensate for the thickness of the projections 92 of the elements 6, so as to obtain a substantially flat external surface of the layer 34.

Figure 20:
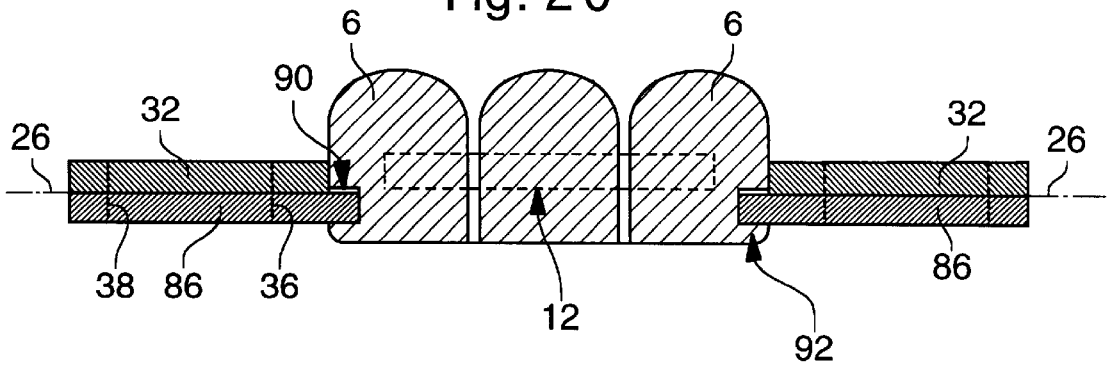

A seventh embodiment is shown in FIG. 20, in which the flexible structure 86 also forms the lower layer of the flexible part of the bracelet. As in the sixth embodiment, the internal edges 60 of the two longitudinal parts of the structure 86 can be hardened or specially treated in order to ensure a firm and reliable fixing of the hard and flexible structures. It is noted that, in this embodiment, the lower faces of the elements 6 are not covered.

Figure 21:
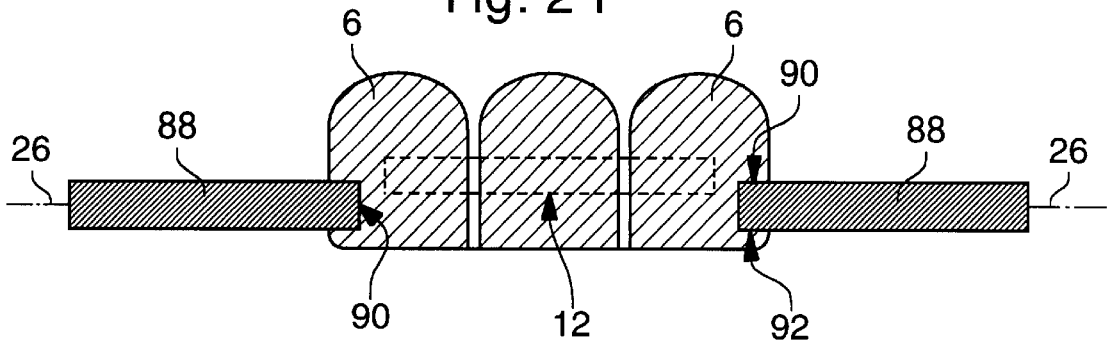

A simplified eighth embodiment of the invention is shown in FIG. 21, in which the flexible part of the bracelet is formed essentially by the flexible structure 88. This structure 88 is formed in particular of leather, rubber or an elastic material.

It is recalled that, in the sixth, seventh and eighth embodiments, the flexible structures 84, 86 and 88 have an essential feature of the invention in each case, namely that they comprise elastically deformable parts which are stressed during the assembly of the elements 6 with the flexible structure. In these three last modes, the internal edges 60 of the flexible structure forming the complementary parts of the fixing means preferably have an upper face and a lower face substantially parallel to the general surface 26 of the flexible structure. In these three latter embodiments, the lateral grooves 90 in which engage the edges 60 of the flexible structure 84, 86 or 88 also have a profile defining an upper face and a lower face substantially parallel to the general surface 26. Thus, the complementary parts defining the complementary fixing means of the hard structure and of the flexible structure mutually form abutments acting in a direction perpendicular to the general surface 26. Accordingly, even if the edges 60 have some elasticity or flexibility, and thus some tendency to deform elastically, retention of the assembly of the flexible and hard structures can be guaranteed. The man skilled in the art will be able to determine suitable materials and in particular the possible gripping force of the elements 6 by the flexible structure 84, 86 or 88.

Finally it is noted that the man skilled in the art can provide compensating or making up layers in order to compensate for differences in thickness between the median region and the lateral regions of the bracelet. Variations in the thickness of the illustrated layers and of the flexible structure serving to fix the hard elements can also be provided.

What is claimed:

1. A bracelet comprising a plurality of hard elements and a flexible structure having elastically deformable parts and at least one opening therein with edges at least partially defined by said elastically deformable parts;

said hard elements being disposed at least partly in said at least one opening and, over a given length of said bracelet, being directly connected together in an articulated manner to form links of a median structure which fills said at least one opening;

said flexible structure defining, along a longitudinal direction of the bracelet, a surface including a median region in which said at least one opening is located, and two lateral regions located, respectively, on opposite sides of said median region; and, complementary fixing means for assembling said median structure to said flexible structure, said complementary fixing means comprising lateral parts provided on at least some of said hard elements and portions of said flexible structure adjacent said at least one opening engageable by said lateral parts to prevent movement of said median structure relative to said flexible structure in a direction normal to said surface;

said median structure being larger than said at least one opening.

2. A bracelet as claimed in claim 1, wherein said flexible structure comprises two longitudinal parts arranged in said two lateral regions, respectively, and transverse parts connecting said longitudinal parts, said two longitudinal parts defining at least partially said complementary fixing means.

3. A bracelet as claimed in claim 2, wherein said hard elements at least partially cover said transverse parts and have grooves for passage of said transverse parts.

4. A bracelet as claimed in claim 2, wherein said transverse parts comprise said elastically deformable parts of said flexible structure.

5. A bracelet as claimed in claim 4, wherein said flexible structure comprises a material selected from the group of materials consisting of plastics material, polyester, polyamide, a material based on natural fibers, a material based on synthetic fibers, Kevlar®, a natural rubber, synthetic rubber based on Neoprene®, and silicone.

6. A bracelet as claimed to in claim 2, wherein said two longitudinal parts have wings along their respective internal edges defining at the same time said elastically deformable parts and said edges of said complementary fixing means.

7. A bracelet as claimed in claim 6, wherein said flexible structure comprises a thin lamella, said wings having sufficient resistance to deformation to insure firm assembly of said hard elements with said flexible structure.

8. A bracelet as claimed in claim 7, wherein said thin metal lamella is a stainless steel lamella.

9. A bracelet as claimed in claim 1, wherein said lateral parts provided on said hard elements comprise lower peripheral projections, each having a face substantially parallel to said surface defined by said flexible structure, and arranged opposite a lower surface of said two longitudinal parts which is also parallel to said surface defined by said flexible structure.

10. A bracelet as claimed in claim 2, wherein said flexible structure is covered at least for the most part by a flexible upper cover layer having at least one opening for passage of said plurality of hard elements, said transverse parts not being covered by said upper cover layer.

11. A bracelet as claimed in claim 1, wherein said lateral parts of said hard elements define lateral peripheral grooves in which said edges are engaged.

12. A bracelet as claimed in claim 1, wherein said lateral parts and said edges have complementary profiles allowing assembly of said median structure and said flexible structure by force/pressing on said plurality of hard elements to elastically deform said flexible structure.

13. A bracelet as claimed in claim 1, wherein said flexible structure is covered at least for the most part by a flexible upper cover layer having at least one opening for passage of said plurality of hard elements.

14. A bracelet as claimed in claim 13, wherein the hard elements which are adjacent said upper cover layer at least partially cover the edges of the at least one opening in said upper cover layer.

15. A bracelet as claimed in claim 13, wherein said upper cover layer comprises a material selected from the group of materials consisting of leather, fabric and rubber.

16. A bracelet as claimed in claim 13, wherein said flexible structure is covered at least for the most part by a flexible lower cover layer which covers said plurality of hard elements.

17. A bracelet as claimed in claim 16, wherein said flexible lower cover layer comprises a material selected from the group of materials consisting of leather, fabric and rubber.

18. A method of assembling a bracelet having the structure defined in claim 4, said method comprising the steps of:

a) with a gripping means, spreading apart the two longitudinal parts of the flexible structure through elastic elongation of the transverse parts of the flexible structure;

b) orienting the lateral parts of the hard elements relative to the flexible structure so that the lateral parts will engage said portions of the flexible structure when the plurality of hard elements are introduced into the median region;

c) introducing the plurality of hard elements into the median region; and, d) restoring the two longitudinal parts of the flexible structure to an assembled position in which the transverse parts are either not elastically deformed or are elastically deformed so that the two longitudinal parts exert a transverse and lateral force on the hard elements, the restoring being accomplished by releasing the gripping means so that the longitudinal parts of the flexible structure move into the assembled position because of contraction of the elastically elongated transverse parts of the flexible structure.

* * * * *